US005405673A

United States Patent [19]

Seibert

[11] Patent Number: 5,405,673

[45] Date of Patent: Apr. 11, 1995

[54] SHOOTING RANGE BACKSTOP

[76] Inventor: George M. Seibert, 36591 Haverhill St., Sterling Heights, Mich. 48312

[21] Appl. No.: 40,140

[22] Filed: Mar. 30, 1993

[51] Int. Cl.[6] ..... B32B 3/10; A63B 67/00; F41H 5/02

[52] U.S. Cl. ..... 428/137; 428/63; 428/99; 428/100; 428/109; 428/114; 428/131; 428/138; 428/166; 428/172; 428/175; 428/179; 428/911; 428/912; 428/495; 428/518; 273/317; 273/346; 273/348; 89/36.02

[58] Field of Search ..... 428/156, 172, 182, 252, 428/246, 267, 33.55, 63, 99, 100, 109, 107, 114, 166, 175, 179, 131, 137, 138, 911, 912, 495, 518; 273/317, 46, 48; 2/2.5, 6, 412; 89/36.01, 36.02

[56] References Cited

U.S. PATENT DOCUMENTS 4,678,702 7/1987 Lancaster et al. ..... 428/252
5,190,802 3/1993 Pitato ..... 428/111

OTHER PUBLICATIONS

"Surlyn® Products Guide", DuPont Co. H-24231 (Mar. 1990).

*Primary Examiner*—Donald J. Loney
*Attorney, Agent, or Firm*—Gifford, Krass, Groh, Sprinkle, Patmore, Anderson & Citkowski

[57] ABSTRACT

A backstop for firearm projectiles includes a body of an ionomeric polymer disposed so as to slow and stop projectiles. The body of ionomeric material may comprise a plurality of spaced-apart sheets.

10 Claims, 2 Drawing Sheets

SHOOTING RANGE BACKSTOP

FIELD OF THE INVENTION

This invention relates generally to shooting ranges. More particularly, the invention relates to backstop structures for shooting ranges.

BACKGROUND OF THE INVENTION

Target shooting is a widespread activity, both for purposes of recreation and in connection with the training of law enforcement officers, military personnel and individuals interested in personal self-defense. Indoor target ranges provide a safe and controlled environment for year-around shooting. Furthermore, indoor target ranges minimize the impact of noise and the hazards of stray projectiles on the surrounding environment; hence, they are of increasing popularity in urban areas.

In any target range, and in an indoor range in particular, it is necessary to provide a backstop structure which will halt projectiles and prevent damage from ricochets or bullet fragments. Any backstop structure should be highly resistant to impact by projectiles and/or readily replaceable or renewable. The simplest backstop structure comprises a volume of earth. While earth backstops are low in cost, they typically occupy a large volume and require supporting or confining structures to retain the earth. Additionally, if the earth is not contained shooting can generate significant amounts of dust.

Metal deflectors have long been employed in shooting ranges to trap bullets. As is,well known in the art, these structures generally comprise a series of inclined metal plates or baffles which slow the bullets and guide them to a collection point. The weight and complexity of metal deflectors makes them expensive to purchase and install. Furthermore, they are quite noisy in operation. A most significant problem associated with metal backstops is the fact that bullets striking them readily fragment and generate lead dust which has been recognized as a significant environmental hazard associated with target ranges.

The use of certain bullet absorbing backstops can eliminate or minimize the problem of lead dust generation. Such backstops include earth, as noted above, and can also include materials such as wood or rubber. Wood is not a practical backstop material since rather large amounts are needed to stop most calibers of bullets. Furthermore, wood is very quickly damaged by repeated impacts. In some instances, rubber-based materials are employed as backstops. These materials generally comprise rubber and fabric composites such as shredded and rebonded tires, industrial conveyor belts and the like. Rubber-based materials are effective at slowing and trapping projectiles; however, in use they tend to accumulate trapped projectiles and eventually deteriorate. Furthermore, rubber-based materials are quite expensive.

It will be appreciated from the foregoing that there is a need for an improved backstop for target ranges. The backstop should stop and/or trap bullets without generating significant amounts of lead dust. Furthermore, it should be resistant to repeated bullet hits and it should be low in cost and readily renewable. The present invention addresses this need by providing a backstop structure which effectively slows and stops a variety of different calibers of bullets. The backstop structure is lightweight, low cost and modular. It may be configured to accommodate a variety of calibers and loads and is readily repaired. These and other advantages of the present invention will be readily apparent to those of skill in the art from the drawings, discussion and description which follow hereinbelow.

BRIEF DESCRIPTION OF THE INVENTION

There is disclosed herein a backstop for firearm projectiles. The backstop includes a body of an ionomer of the type comprising a metallic salt of a copolymer of ethylene and a vinyl monomer having an acidic group. In one embodiment of the backstop, the body of ionomer comprises a plurality of separate sheets disposed so that a bullet fired at the backstop passes through each of the plurality of sheets in sequence. In another particular embodiment, the body of ionomer is configured as an elongated member having a chevron-shaped cross section. The elongated member is disposed so that its length is generally perpendicular to the path of bullet travel. The elongated member may comprise a plurality of separate sections, each having a chevron-shaped cross section, with said sections being fastened together in an end-to-end relation, as for example, by means of separable hook and loop fastener material in one particular embodiment, the ionomer comprises a sodium or a zinc salt of a copolymer of ethylene and methacrylic acid.

In some instances, the ionomeric material may further include a layer of aramide polymer laminated thereto. In other instances, the backstop may further include a back wall comprised of a rubber-based material disposed down range of the body of ionomer so that the expected path of travel of a bullet fired at the backstop will pass through the ionomer and into the wall.

DETAILED DESCRIPTION OF THE INVENTION

Figure 1:
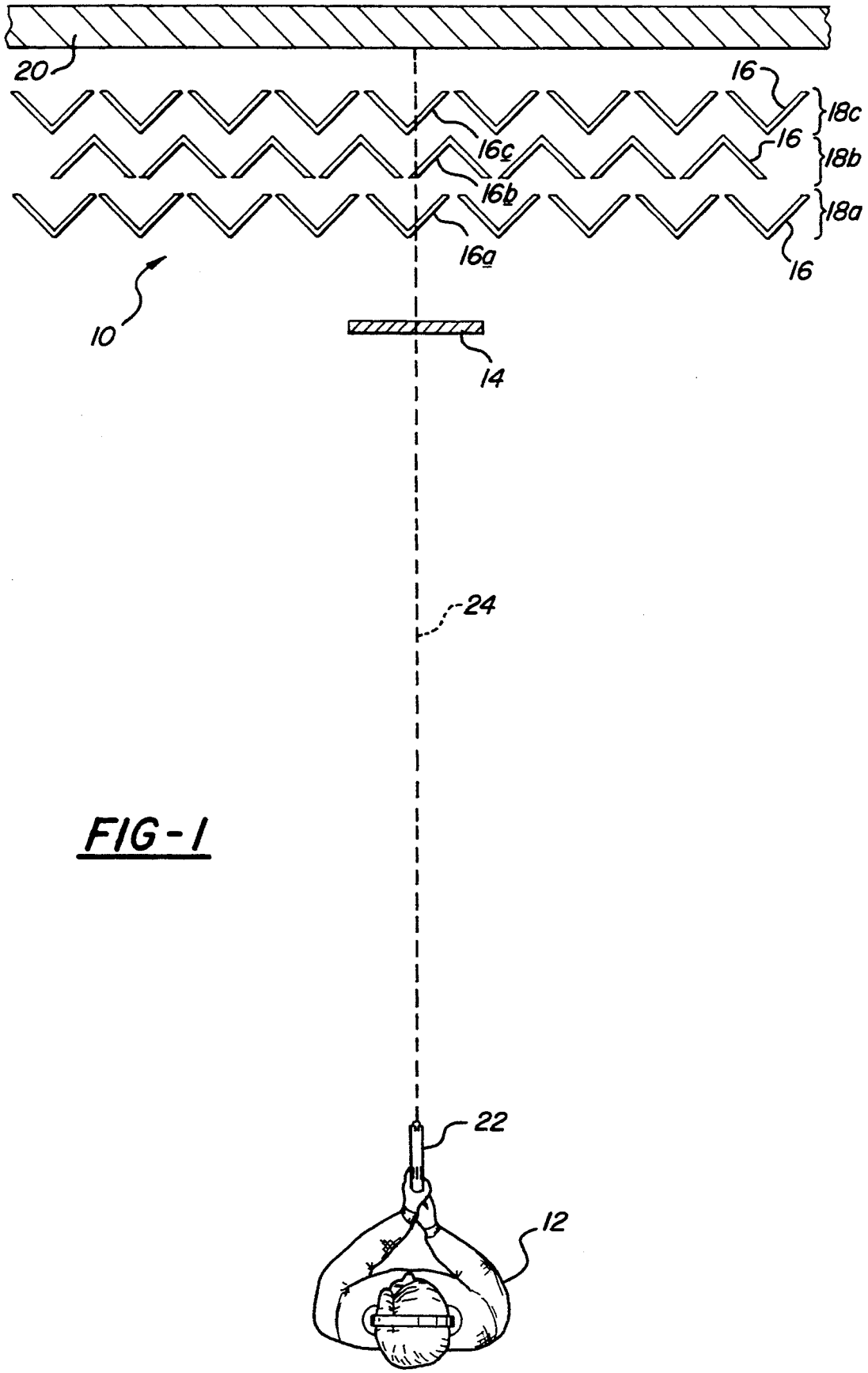
FIG. 1 is a top plan view-of a shooting range including one embodiment of backstop structured in accord with the present invention.
Figure 2:
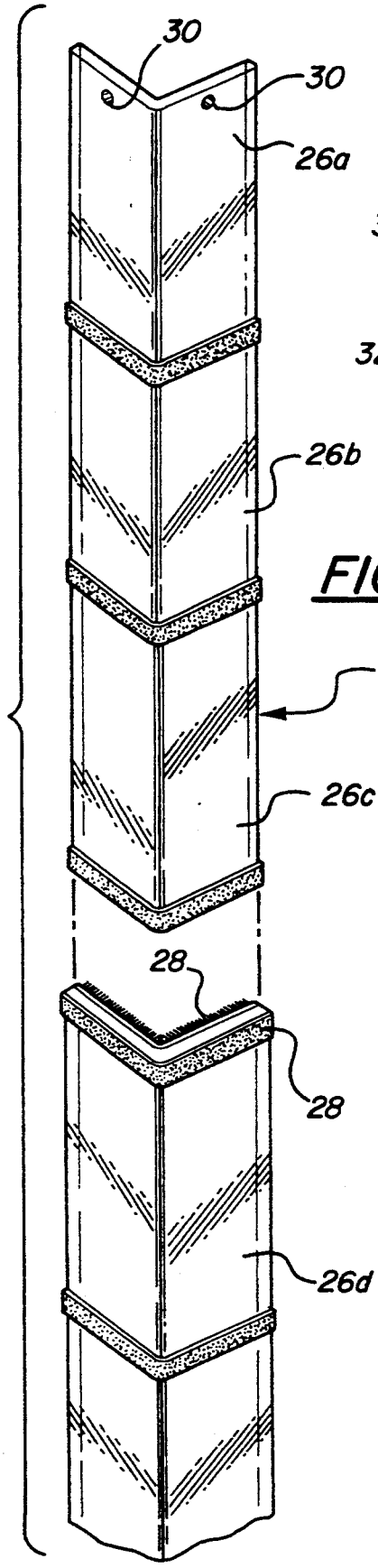
FIG. 2 is a perspective view of one of the members which comprise the backstop of the present invention showing a portion thereof detached.

Referring now to FIG. 1, there is shown a top plan view of a target range which includes a backstop 10 structured in accord with the principles of the present invention. Also shown in the figure is a shooter 12 and a target 14. In the illustrated embodiment, the backstop 10 includes a number of members 16 of generally chevron-shaped cross section. These members are elongated along a length running generally perpendicular to the drawing and one particular embodiment thereof is illustrated in FIG. 2. The chevron-shaped members 16 are, in this embodiment, arrayed in three groups 18*a*, 18*b*, 18*c*. It will be noted that the thickness of the chevron-shaped member 16 increases progressively from front to back in this embodiment, although it is to be understood that in keeping with the principles of the present invention, the thicknesses may all be the same or they may vary in another manner.

The individual members 16 are fabricated from a type of polymer referred to as an ionomer. This material comprises a metallic salt of a copolymer, an olefin such as ethylene and a vinyl monomer having an acidic grouping thereon. In an ionomer, linkage of the polymeric chain is accomplished by ionic as well as covalent bonds. It has been found, in accord with the principles of the present invention, that ionomeric polymers are very effective at slowing and absorbing bullets. It has been found that a bullet passing through a sheet of ionomeric polymer will initially stretch the material and form an opening which reseals itself after the bullet has passed. In so doing significant kinetic energy is absorbed. Subsequent sheets of material will further slow and stop the bullet. This process provides for a gradual slowing which does not significantly deform or abrade the bullet; therefore, no lead dust is generated, and in many instances the bullet may be readily recycled or reused.

One ionomeric polymer having particular utility in the present invention is the sodium or zinc salt of a copolymer of ethylene and methacrylic acid. Materials of this type are available under the designation Surlyn® from the DuPont Corporation. The materials sold under the grade designation 8940 has been found to be particularly advantageous for fabricating backstops. This material includes the sodium cation and it has a nominal density of 0.95 g/cm$^3$; a melt flow index of 2.8 g/10 minutes per ASTM D-1238; a notched izod toughness of 1025 J/cm per ASTM D-256; a tensile impact of 1020 kJ/m$^2$ at 20° and 760 kJ/m$^2$ at −40° C. per ASTM D-1822s;it has a flexural modulus of 350 MPa at 23° C. per ASTM D-790; a tensile of strength 33.1 MPa, a yield strength of 15.9 MPa and an elongation of 470% all per ASTM D-638. Its shore D hardness is 65 per ASTM D-2240. The melting point of this polymer per dta analysis is approximately 81°–96° C. and its freezing point is approximately 51°–80°. Other grades of Surlyn® polymer, particularly grade 8920 have generally similar properties and are also usable in the practice of the present invention. In those instances where low temperature conditions are encountered, as for example in outdoor ranges, materials with better low temperature properties, such as Surlyn® 8020, may be employed. It is to be understood that other ionomeric polymers, particularly those having properties similar to those herein described may also be employed in the practice of the present invention. In some instances the ionomeric material may be further modified by the inclusion of fire retardant agents, coloring agents and the like. As will be described in greater detail hereinbelow, reinforcing layers or other composite structures may be included in combination with the ionomeric material.

Referring back to FIG. 1, it will be seen that the backstop 10 of the illustrated embodiment further includes a back wall 20. This back wall is most preferably fabricated from a projectile-absorbing material such as a rubber-based composite, such as that sold by the Dodge-Regupol Corporation of Lancaster, Pa. under the designation "shooting blocks." The back wall may also be comprised of other projectile absorbing material such as earth, wood, polymers or the like. In general, the projectile stopping ability of the ionomeric member 16 will be sufficient so that any impacts on the back wall 20 will be very minimal.

In the illustrated embodiment, the shooter 12 is firing a pistol 22 at a target 14. The expected path of travel 24 of the bullet extends from the pistol 22, through the target, through an ionomeric member **16*a* of the first plurality 18*a*; through a second ionomeric member 16*b* of the second plurality 18*b*; through a third member 16*c* of the third plurality 18*c* and into the back wall 20. While the path of travel 24 is shown as a straight line, it has been found that the material of the present invention causes the bullet to tumble; hence after passing through the first member 16*g*, the path may become erratic. Preferably, the thickness of the number and placement of the ionomeric bodies 16 will be selected so that the majority of expected projectiles will be stopped before striking the back wall 20**. In most instances, four to eight layers of material of approximately ¼ inch thickness will stop all expected projectiles. In some instances, fewer, thicker sheets of material may suffice. In a series of practical tests employing Surlyn® 8940 of ¼ inch thickness, it was found that a 0.380 caliber jacketed solid-point bullet fired at 90° to an array of ¼ inch sheets would pass through two sheets and be stopped by a third. Under the same conditions, a 9 mm jacketed solid-point bullet required six ¼ inch sheets to stop it. When the 9 mm bullet was fired at a 45° angle to the sheets, it was stopped by the fourth.

The FIG. 1 embodiment illustrates ionomeric members 16 having a chevron-shaped cross section. It has been found that by orienting the sheets so that a projectile impacts thereupon at a somewhat oblique angle, greater stopping power is provided. It has also been found advantageous to stagger the chevrons in adjacent rows so as to provide maximum opportunities for interaction between the projectiles and the ionomeric material.

Referring now to FIG. 2, there is shown a perspective view of one embodiment of ionomeric member which may be employed in the practice of the present invention. The member 16 of FIG. 2 is of generally chevron-shaped cross section, and it is fabricated from a plurality of separate sections **26*a*,26*b*,26*c*,26*d*. In the illustrated embodiment, section 26d is shown detached from the remaining sections and it is to be understood that in accord with the present invention, a larger or smaller number of sections may be similarly added. In the illustrated embodiment, each of the individual sections 26 includes fastening means such as separable hook and loop fastener material 28** for joining that section to others.

As illustrated, the hook and loop fastener material 28 is disposed on both sides of the individual portions 26 proximate both the top and bottom thereof. In this manner, any number of sections may be joined, in any order, to form an elongated ionomeric member. As illustrated, the topmost section **26*a* includes several holes 30 for supporting the member in position on the shooting range. It has been found that by fabricating the member 16 in sections 26**, its lifetime is greatly increased since sections near the center which are more likely to be impacted by projectiles may be either replaced or switched with sections nearer to the end. It has also been found that the ionomeric material of the present invention may be readily recycled by melting and recasting.

Figure 3:
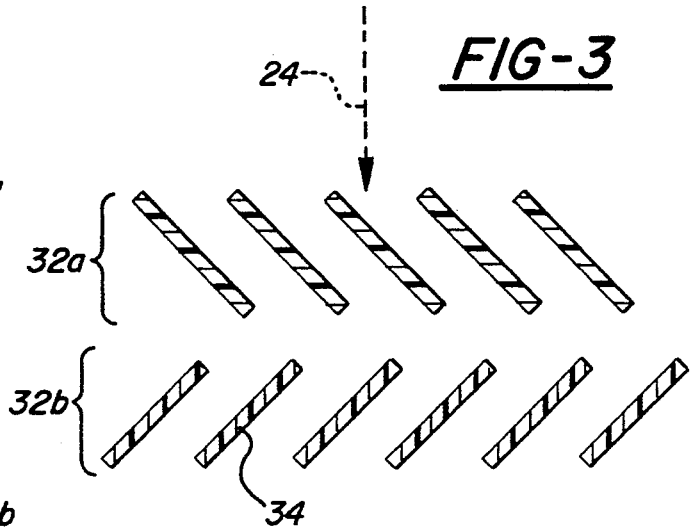
FIG. 3 is a top plan view in cross section of another embodiment of backstop structured in accord with the principles of the present invention.

It is to be understood that while the backstop has heretofore been described as comprising a plurality of separate chevron-shaped members, other arrangements of ionomeric material may be employed in keeping with principles of the present invention. FIG. 3 illustrates a top plan view of a portion of a backstop structured in accord with another embodiment of the invention. In the FIG. 3 embodiment, sheets of ionomeric material 34 are arranged in a first plurality 32*a* and a second plurality 32*b*. The first plurality 32*a* is disposed up-range of the shooter, and the second plurality 32*b* is disposed down-range. It will also be noted that the individual sheets 34 of each plurality are disposed at an angle to the expected path of travel 24 of a bullet.

Figure 4:
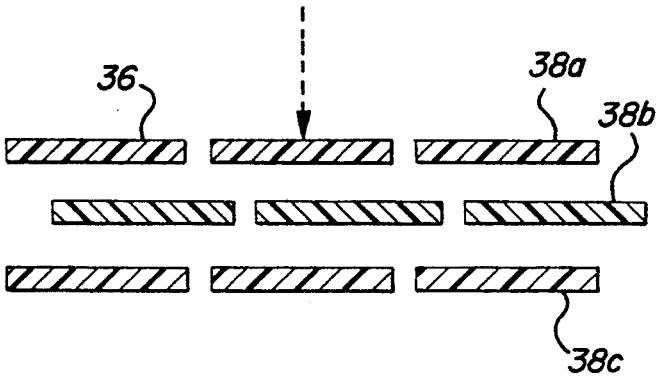
FIG. 4 is a top plan view in cross section of yet another embodiment of backstop structured in accord with the principles of the present invention.

FIG. 4 illustrates yet another embodiment of backstop structure. In this embodiment, individual sheets of ionomeric material 36 are disposed in three rows 38*a*,38*b*,38*c*. Each row is offset slightly with respect to adjacent rows so that the effect of gaps between the sheets is minimized.

Figure 5:
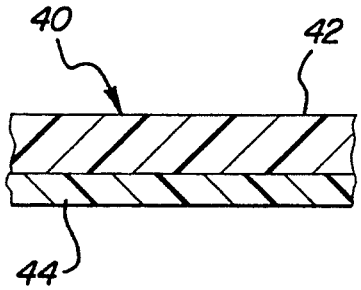
FIG. 5 is a cross-sectional view of a portion of a backstop structured in accord with yet another embodiment of the present invention.

Referring now to FIG. 5, there is shown a portion of a sheet of ionomeric based material 40 which may be employed in the practice of the present invention. The sheet 40 of FIG. 5 is comprised of a body of ionomeric material 42, generally similar to that described hereinabove, which sheet is laminated to a layer of reinforcing material 44. The reinforcing material 44 may comprise a polymeric sheet, or it may comprise reinforcing fibers such as glass fibers, polymeric fibers or natural fibers. In one particular embodiment, the reinforcing material 44 comprises a layer of aramide material such as Kevlar ® sold by the DuPont Corporation. The reinforced sheet of ionomeric material is most preferably employed as the final layer in the backstop structure, although in some instances, it may be utilized to comprise each of the layers.

It will be appreciated from the foregoing that a highly efficient backstop for firearm projectiles may be fabricated by employing a body of ionomeric material as a bullet trapping and slowing member. The ionomeric material may be employed as a single body, or in the form of a plurality of separate sheets. The number and orientation of the sheets will depend upon the caliber and load of the projectile being fired at it. Therefore, it is to be understood that the invention may be practiced in particular forms which differ from those disclosed herein. The drawing, discussion, description and example set forth herein are merely meant to illustrate particular embodiments of the invention and are not meant to be limitations upon the practice thereof. It is the following claims, including all equivalents, which define the scope of the invention.

I claim:

1. A backstop for fire arm projectiles including:

a body formed of at least one sheet of an ionomeric material comprising a metallic salt of a copolymer of ethylene and a vinyl monomer having an acidic group, wherein said body of ionomer is configured as an elongated member having a chevron shaped cross section, and said elongated member is disposed so that the length thereof is generally perpendicular to an expected path of travel of a bullet fired at said backstop.

2. A backstop as in claim 1 wherein said body of ionomeric material comprises a plurality of separate sheets of said ionomer disposed so that an expected path of travel of a bullet fired at said backstop passes through said plurality of sheets in sequence.

3. A backstop as in claim 1, wherein said elongated member comprises a plurality of separate sections, each having a chevron shaped cross section, said sections being fastened together in an end-to-end relationship.

4. A backstop as in claim 3, wherein said sections are fastened together by separable hook and loop fastener material.

5. A backstop as in claim 1 wherein said ionomeric material comprises a sodium or zinc salt of a copolymer of ethylene and methacrylic acid.

6. A backstop as in claim 1 wherein said body of ionomeric material further includes a layer of aramide polymer laminated thereto.

7. A backstop as in claim 1, further including a back wall comprised of a rubber based material disposed downrange of said body of ionomeric material so that the expected path of travel of a bullet fired at said backstop will pass through said ionomer and into said back wall.

8. A backstop for fire arm projectiles comprising:

a first and a second plurality of elongated members each having length and a a generally chevron shaped cross section, each disposed so that the length thereof is generally perpendicular to an expected path of travel of a bullet fired at said backstop, each elongated member comprised of an ionomeric polymer which is a sodium or zinc salt of a copolymer of ethylene and methacrylic acid;

the elongated members of said first plurality being disposed so that the lengths thereof are in a generally parallel relationship; and the elongated members of said second plurality being disposed so that the lengths thereof are in a generally parallel relationship and so that said second plurality of elongated members is disposed down range of said first plurality of elongated members so that the expected path of travel of said bullet passes in sequence through at least one member of said first plurality and at least one member of said second plurality.

9. A backstop for fire arm projectiles including:

a body formed of at least one sheet of an ionomeric material comprising a metallic salt of a copolymer of ethylene and a vinyl monomer having an acidic group, said sheet of ionomeric material being capable, upon passage of a bullet therethrough, of forming an opening which reseals itself; and a backwall disposed downrange of said body of ionomeric material so that a bullet fired at the backstop will form, and pass through, an opening in said ionomeric material so as to strike said back wall, whereby said opening will reseal itself so as to stop any fragments of said bullet resultant from impact thereof with said backwall.

10. A backstop as in claim 9, wherein said back wall is comprised of a rubber based material.

* * * * *